United States Patent [19]

Carlson et al.

[11] Patent Number: 4,513,591

[45] Date of Patent: Apr. 30, 1985

[54] SPRING SECURITY LOCK

[75] Inventors: John H. Carlson, West Boylston; Anthony J. Agbay, Auburn, both of Mass.

[73] Assignee: Omco Inc., Holden, Mass.

[21] Appl. No.: 547,381

[22] Filed: Oct. 31, 1983

[51] Int. Cl.[3] ..... E05B 67/36

[52] U.S. Cl. ..... 70/34; 70/386

[58] Field of Search ..... 70/14, 32, 33, 34, 386, 70/23, DIG. 54, DIG. 55

[56] References Cited

U.S. PATENT DOCUMENTS

| | | | |
|---|---|---|---|
| 1,923,025 | 8/1933 | Morse | 70/34 |
| 3,002,368 | 10/1961 | Moberg | 70/14 |
| 3,835,674 | 9/1974 | Hoyt | 70/34 |
| 4,040,279 | 8/1977 | Sigmorelli | 70/34 |
| 4,441,343 | 4/1984 | Nielsen | 70/34 |

*Primary Examiner*—Robert L. Wolfe

*Attorney, Agent, or Firm*—Thompson, Birch, Gauthier & Samuels

[57] ABSTRACT

A high security spring lock and an associated key for locking and unlocking the lock. The lock has a cylindrical barrel with an axial bore. A main compression spring and a secondary compression spring are coaxially mounted in the bore and bear against each other and against opposite ends of the bore. A pair of locking balls constrained for limited movement in radially extending passageways are held radially outward in a locking position by the main compression spring.

The key has elongated outer expanding fingers and an inner coaxially arranged center pin. When the key is fully inserted into the lock and the key handle is operated, the expanding fingers are initially radially expanded to grip the inner surface of the main compression spring and are then longitudinally retracted to draw the main compression spring rearwardly. Simultaneously, the key center pin prevents the secondary compression spring from expanding to follow the rearwardly drawn main compression spring, thereby permitting the locking balls to move radially inward to an unlocking position.

18 Claims, 11 Drawing Figures

122
72
26
30
28
20
14
44
22
32
40
16
42
18
56
70
24

20
102
36
80
89
104
108
38
16
34
18

122

122

72
44
104
108
70
44
104
106
16
70
56

SPRING SECURITY LOCK

BACKGROUND OF THE INVENTION

Prior art barrel locks and keys are shown in U.S. Pat. Nos. 1,923,025; 3,002,368; 3,835,674; and 4,040,279. The disclosures of these patents are incorporated by reference and made a part of the present disclosure. These prior art locks and keys have become increasingly less secure with the passage of time because of the relatively wide, albeit substantially controlled, distribution and use of the keys by a large number of people. Assignee's copending U.S. Pat. No. 4,441,343, the disclosure of which is incorporated herein by reference, describes one approach to overcoming this problem.

It is the object of this invention to provide a high security lock which cannot be opened with a conventional key or with picks or nails.

SUMMARY OF THE INVENTION

The high security spring lock of this invention is similar in many respects to the prior art locks. However, in the present invention, main and secondary compression springs are coaxially mounted within an axial bore in the lock barrel. In the locked position, the springs bear against each other and the ends of the bore to limit radial inward movement of the locking balls.

A key used with this invention is specifically designed to open the high security lock of this invention. It is somewhat similar to the prior art keys. However, a key center pin is telescopically provided within the outer expanding fingers. The purpose of the key center pin is to prevent rearward axial movement of the secondary compression spring when the lock is being unlocked.

The key has a plunger which is reciprocated by a key handle. The key plunger is retracted by the key handle causing the expanding fingers to initially spread radially and clamp onto the main compression spring, and then to retract axially while the key center pin remains stationary and holds the compressed secondary compression spring in place.

Thus, when the key is inserted into a lock whose locking balls are normally in the locking position, the center pin contacts the secondary compression spring. Then, when the key handle is operated, the main compression spring is retracted by the key's expanding fingers, and the secondary compression spring remains compressed and is prevented by the key center pin from expanding. This dual action permits the locking balls to move radially inwardly to their unlocking position and permits the unlocked lock to then be withdrawn entirely.

DESCRIPTION OF THE PREFERRED EMBODIMENTS

Figures 1, 2, 3, 4:
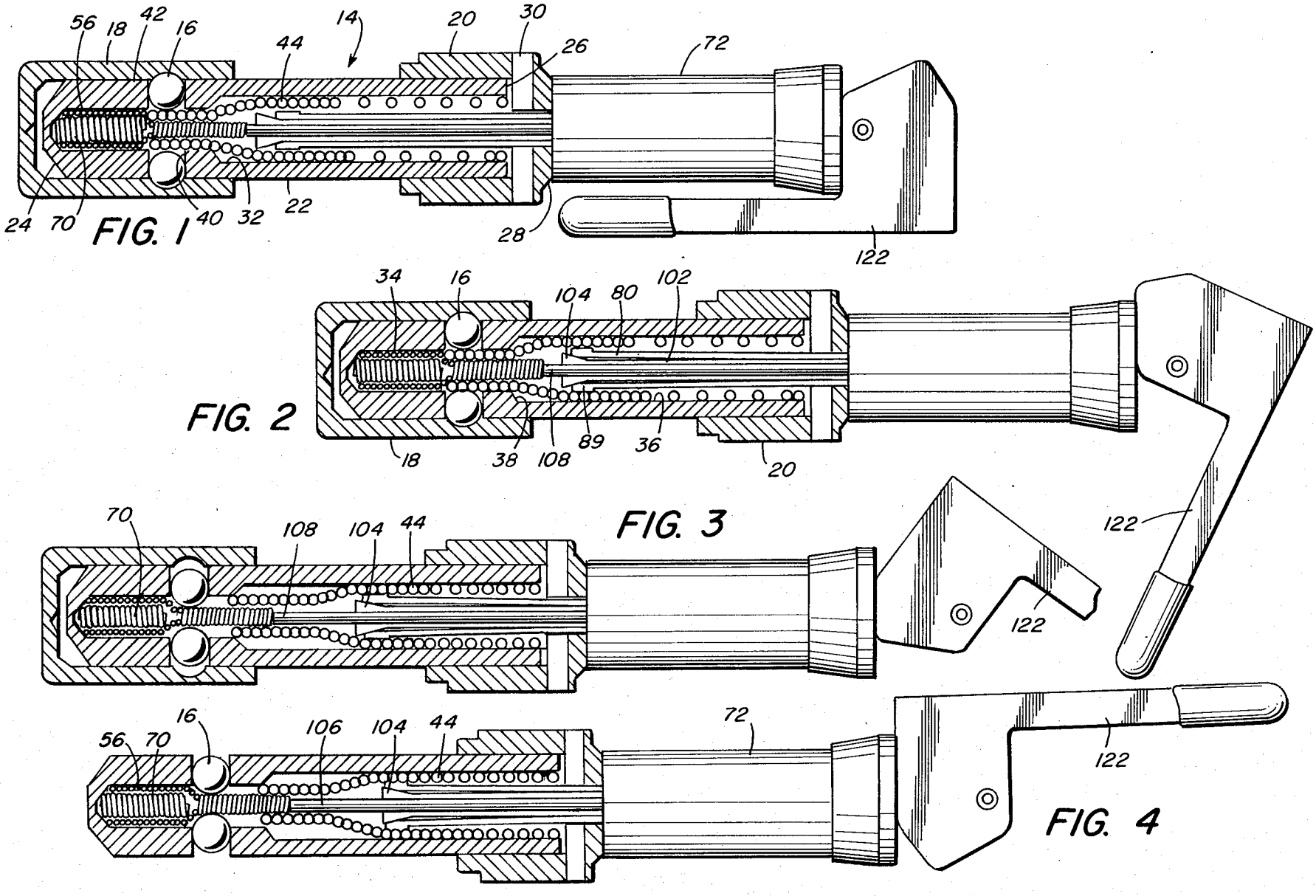
FIG. 1 is a vertical section of the preferred embodiment of the compression spring lock of this invention, hereafter called spring lock. The lock is shown in its locked condition with the key shown inserted into the spring lock and with the key handle shown in its first position.
FIG. 2 is a vertical section showing the spring lock of FIG. 1 in its locked condition and the key handle has been pivoted to its second position causing the key expanding fingers to fully engage the lock main compression spring while the key center pin remains in contact with the secondary compression spring.
FIG. 3 is similar to FIG. 2 except that the key handle has been pivoted to its third position causing the key expanding fingers to partially retract the lock main compression spring while the key center pin remains in contact with the secondary compression spring and prevents the lock secondary compression spring from retracting with the lock main compression spring, the lock main compression spring clearing the locking ball passageway inner apertures. Because the key center pin maintains the lock secondary compression spring forward, the locking balls have moved radially inwardly and the spring lock is now in its unlocked condition.
FIG. 4 is similar to FIG. 3 except that the key handle has been pivoted to its fourth position causing the key expanding fingers to fully retract the lock main compression spring and the lock has been longitudinally withdrawn from the front end cap to which it was previously secured.

FIG. 1 shows a spring lock 14 of the invention in its locked condition wherein its two locking members 16, for example locking balls, have been forced radially outwardly so that they engage a groove in a front end cap 18. Thus, when spring lock 14 is in its FIGS. 1 and 2 locked condition, it cannot be longitudinally removed from front end cap 18.

Spring lock 14 can be used in many situations to lock two elements against various types of relative movement. Front end cap 18 illustrates but one locking situation of the type wherein two unshown apertured flat panels have the lock inserted through and both the two flat panels are prevented from separating by the large rear end cap 20 of the lock on one side and the large front end cap 18 on the other side. There are many other situations in which spring lock 14 is useful.

Spring lock 14 has a hollow cylindrical lock barrel 22 which has a closed front end 24 and an open rear end 26. Rear end cap 20 is fitted over and fixed to open rear end 26 enlarging its effective outer diameter and creating an apertured rear end 28 with a selected aperture size. A transverse passage 30 is also provided to accommodate a conventional "tell tale" or lead seal used to signal tampering.

The spring lock barrel 22 has a stepped axially extending bore 32 including a front small diameter bore 34 and a rear large diameter bore 36. The diameters are small and large relative to each other. The front bore 34 is joined to the rear bore 36 by an annular shoulder 38, the surface of which extends at an angle to the axis of the barrel bore 32.

The lock barrel 22 also has two radially extending passageways 40 which run from the exterior surface 42 of barrel 22 to the front bore 34 of the lock barrel 22.

The locking balls 16, for example steel locking balls, are movably mounted in the passageways 40 and are free to move radially within the passageways. At the outer aperture of each passageway, a very small inwardly extending peripheral rim is provided which prevents the locking balls 16 from completely escaping outwardly. However, almost half of the locking ball can project outwardly from the passageway as can be seen from FIGS. 1 and 2.

Figure 5:
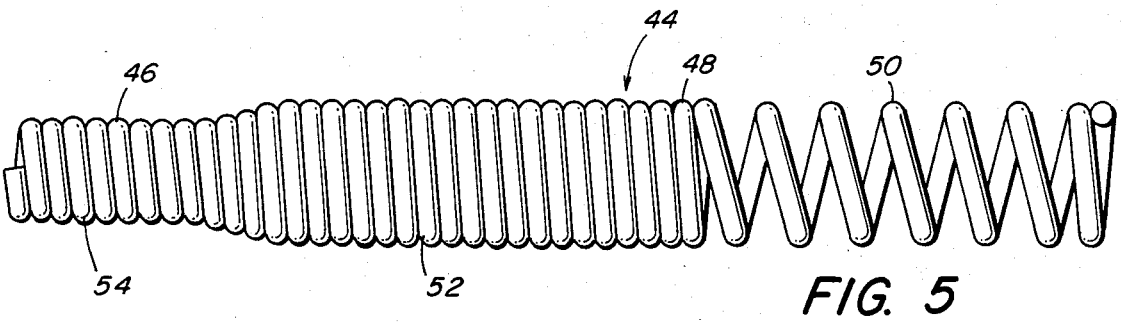
FIG. 5 is a side elevation of the main compression spring.
Figure 6:
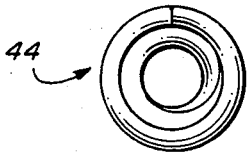
FIG. 6 is an end view of the main compression spring of FIG. 5.

A main compression spring 44, shown in FIGS. 5 and 6, is sized, shaped and mounted to reciprocate within the stepped barrel bore 32. In other words, the front narrow neck portion 46 of main compression spring 44 slidably fits within the front bore 34 of the barrel 22; and the rear enlarged body portion 48 slidably fits within the rear bore 36 of the barrel 22. The rear body portion 48 has a compressible open coiled rear end 50 and a noncompressible close coiled central portion 52, the neck portion 46 being close coiled as shown at 54. Main compression spring 44 has right hand coils.

Figure 7:
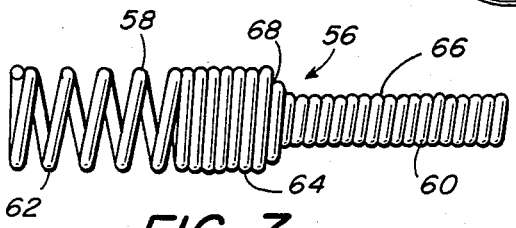
FIG. 7 is a side elevation of the secondary compression spring.
Figure 8:
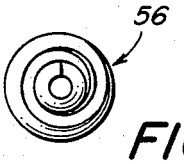
FIG. 8 is an end view of the secondary compression spring of FIG. 7.
Figure 9:
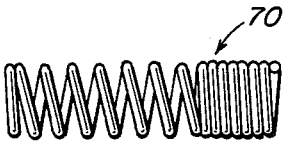
FIG. 9 is a side elevation of the auxiliary spring.
Figure 10:
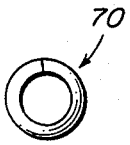
FIG. 10 is an end view of the auxiliary spring of FIG. 9.

A secondary compression spring 56, shown in FIGS. 7 and 8, is sized, shaped and mounted to reciprocate within the stepped barrel bore 32 and the narrow neck portion 46 of the main compression spring 44. In other words, the front enlarged body portion 58 of the secondary compression spring 56 slidably fits within the front bore 34 of the barrel 22 and the rear narrow neck portion 60 fits within narrow neck portion 46 of the main compression spring 44. The front body portion 58 of the secondary body compression spring 56 has a compressible open coiled front end 62 and a noncompressible close coiled central portion 64, the neck portion 60 of the secondary compression spring being close coiled as shown at 66. Secondary compression spring 56 has left hand coils. That is, the coils of the secondary compression spring 56 are wound oppositely to the coils of the main compression spring 44. The close coiled rear end 64 of the secondary compression spring 56 defines a shoulder 68 which engages the front end of the narrow neck 46 of the main compression spring 44. An auxiliary compression spring 70 shown in FIGS. 9 and 10, is sized, shaped and mounted within the enlarged body 58 of the secondary compression spring 56. Auxiliary compression spring 70 has right hand coils. That is, the coils of auxiliary compression spring 70 are wound oppositely to the coils of the secondary compression coil 56. The concentric mounting of oppositely wound compression springs provides lateral strength. The combined axial length of the main compression spring 44 and the secondary compression spring 56, when uncompressed, is greater than the axial length of barrel bore 32. Preferably, the secondary and auxiliary springs are in a fully compressed state within barrel bore 32.

The front exterior portion of neck portion 46 of the main compression spring 44 is normally positioned across and closes the inner apertures of both locking ball passageways 40 causing the lock to be in its locked condition as shown in FIGS. 1–2. The main compression spring 44 forces both locking balls 16 radially outwardly to their locking position because the main compression spring covers the locking ball passageways 40. However, when the main compression spring 44 is compressed, it moves rearwardly and uncovers the passageways 40, permitting the locking balls to move radially inwardly towards the barrel bore 32 and causing the lock to be in its unlocked condition, as shown in FIG. 3.

Figure 11:
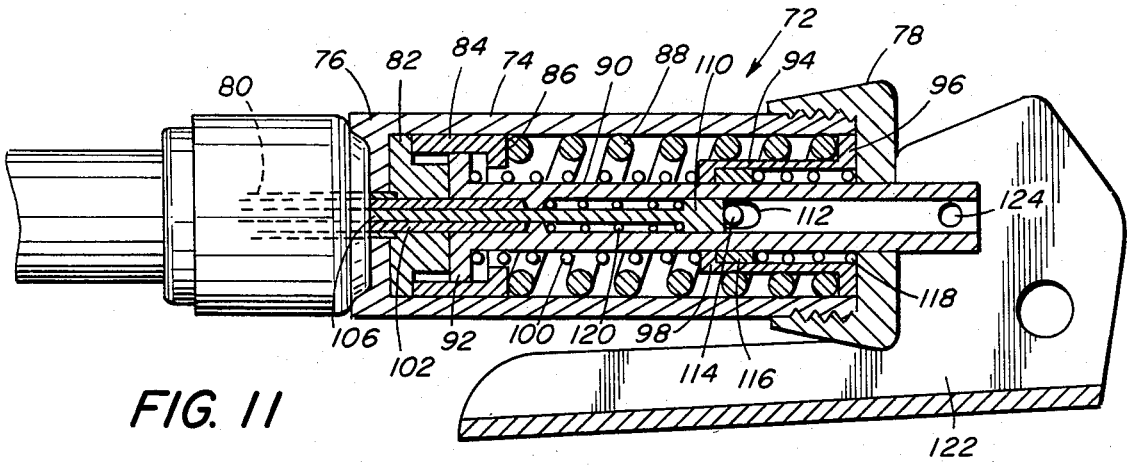
FIG. 11 is a vertical section of the key used with this invention.

The key 72, shown in FIG. 11, will now be described. Key 72 has a hollow cylindrical key barrel 74 with an apertured front end 76 and an open rear end closed by an apertured cap 78 (creating an apertured rear end).

Two elongated outer expanding fingers 80 extend longitudinally through apertured front end 76 and are fixed at their rear portions to a centrally apertured cylindrical enlarged base 82 which is mounted for axial movement within the bore of key barrel 74 providing a sliding fit therebetween.

A centrally apertured front spacer 84 is positioned to the rear of enlarged base 82 and has an inwardly extending rear rim 86. An outer coil spring 88 is positioned between rear rim 86 and key barrel rear end 78 and biases enlarged base 82 and expanding fingers 80 forwardly. The expanding fingers are formed by taking a hollow cylinder and making two diametrically opposed longitudinal slits which run rearwardly from the front end of the cylinder about halfway towards the rear end of the cylinder. The rear end of the cylinder is fixed to the front of the enlarged base and the tips 89 of the expanding fingers 80 are thickened to provide good gripping surfaces. The fingers 80 are radially spreadable and the finger tips 89 are designed to be spread into a gripping relationship with the interior surface of a hollow member such as within main compression spring 44.

To the rear of enlarged base 82, hollow key plunger 90 is coaxially movably mounted within key barrel 74. Key plunger 90 has an enlarged front end 92 and extends rearwardly through apertured rear end 78 of barrel 74. Plunger front end 92 is free to move forwardly until it contacts the rear surface of enlarged base 82, and is free to move rearwardly until it contacts the front surface of rear rim 86.

A centrally apertured rear spacer 94 is positioned adjacent the apertured rear end 78 of the key barrel 74 and has an outwardly extending rear rim 96 and an inwardly extending front rim 98. The rear end of outer coil spring 88 bears against the forward surface of rear spacer rear rim 96 and keeps front spacer 84 and rear spacer 94 spread apart.

A middle coil spring 100 is telescopically mounted around key plunger 90. The front end of spring 100 bears against the rear surface of enlarged front end 92 of the plunger. The rear end of spring 100 bears against the front surface of front rim 98 of the rear spacer. Middle coil spring 100 keeps the plunger and the rear spacer 94 spread apart.

A hollow cylindrical expander rod 102 is telescopically slidably mounted within the center of the outer expanding fingers 80. Expander rod 102 has a frustoconical front end 104 which has its maximum diameter at the front. The rear end of expander rod 102 is fixed to key plunger 90 and passes through the apertured front end 76 of the barrel and the enlarged base 82 of the expanding fingers. The length of the expander rod 102 is greater than the length of the expanding fingers (including the enlarged base).

A key center pin 106 is telescopically slidably mounted within the bore of expander rod 102 and has a front end 108 and an enlarged rear end 110. Center pin 106 extends rearwardly through the rear end of expander rod 102 and into the bore of key plunger 90. Enlarged rear end 110 has a sliding fit in the key plunger bore. The length of the key center pin 106 is greater than the length of the expander rod 102, the center pin being sufficiently long to hold the enlarged body portion 58 of the secondary compression spring 56 forward of the passageways 40 and permit the locking balls 16 to move inwardly in the passageways and unlock the lock.

The plunger 90 has two elongated diametrically opposed slots cut in its intermediate portion forming a transverse slot 112 which has a considerable longitudinal dimension. A stop pin 114 extends through slot 112 and is perpendicular to the axis of the key plunger and the key barrel. The stop pin 114 is fixed to an open-ended hollow cylindrical collar 116 which is telescopically and slidably mounted about the key plunger within the rear spacer 94 and against the rear surface of the front rim 98 of the rear spacer. For all practical purposes, center pin 106, collar 116 and stop pin 114 are fixed against any significant forward or rearward movement relative to the axis of the key plunger, but an adjustment spring 118 is provided about plunger 90 to bias collar 116 forwardly. This adjustment spring is solely for the purpose of compensating for manufacturing variations in the high security locks.

An inner coil spring 120 is telescopically mounted on the key center pin 106 within the bore of key plunger 90 and biases the enlarged rear end 110 of the key center pin 106 rearwardly against the stop pin 114.

The key handle 122 is pivotally attached to the rear end of plunger 90 by a pivot pin 124. Key handle 122 is shaped to be rotated in order to progressively retract key plunger 90 and its associated key parts.

FIGS. 1–4 show the sequence of unlocking steps produced by movement of the key handle 122. FIG. 1 shows the key 72 of this invention fully inserted through the apertured rear end 28 of the lock barrel 22. Main compression spring 44, in its substantially expanded position, bears against the annular shoulder 68 of the compressed secondary compression spring 56 and forces the locking balls 16 radially outwardly to their locking position. In FIG. 1, the key handle is in its first locking position and the key center pin 106 is adjacent the springs 56 and 70.

FIG. 2 shows the key handle rotated to its second position. The lock has not moved at all, but the key fingers 80 have radially expanded to grip the inner surface of the central portion 52 of the main compression spring 44. The key's center pin 106 remains substantially stationary at all times. Preferably, the center pin 106 is in contact with the rear end of the narrow neck portion 66 of the secondary compression spring 56 to prevent rearward movement of it and the auxiliary compression spring 70.

FIG. 3 shows the key handle rotated to its third position. The main compression spring 44 has now been partially compressed and retracted to near its maximum rearward position and the secondary compression spring 56 and auxiliary compression spring 70 remain stationary in their forward positions because of the blocking presence of the key's center pin 106. At this point, the lock becomes unlocked because the main compression spring front exterior neck portion 46 has cleared the inner apertures of passageways 40 and the locking balls are free to move inwardly in the passageways until they contact the narrow neck portion 60 of the secondary compression spring 56.

FIG. 4 shows the key handle rotated to its fourth position. The main compression spring 44 has been fully retracted and the lock has been withdrawn from front end cap 18.

It will be understood from the drawings that if a prior art key or a pick or a nail were inserted in an improper attempt to unlock spring lock 14 by compressing and retracting the main compression spring 46, secondary compression spring 56 would expand and move to its rearward position along with the main compression spring as the main compression spring is retracted. Therefore, when the front exterior neck portion 46 cleared the inner apertures of passageways 40, the close coiled portion 64 of the secondary compression spring 56 would close the inner apertures of passageways 40 and continue to maintain locking balls 16 in their locking position and the lock would remain locked.

The above description obviously suggests many possible variations and modifications of this invention which would not depart from its spirit and scope. It should be understood, therefore, that the invention is not limited in its application to the details of structure specifically described or illustrated and that within the scope of the appended claims, it may be practiced otherwise than as specifically described or illustrated.

What is claimed is:

1. A high security lock comprising:

(a) a hollow cylindrical lock barrel having a closed front end and an apertured rear end, said lock barrel having a stepped axially extending bore, the front bore having a relatively small diameter and the rear bore having a relativley large diameter;

(b) said stepped barrel bore having an annular shoulder forming the junction between said front bore and said rear bore;

(c) at least two radially extending passageways running from an outer aperture in the exterior surface of said lock barrel to an inner aperture in the front bore of said lock barrel, and a locking member mounted in each said passageway for limited movement therein, said locking member restrained from completely escaping through said outer aperture; and (d) compression spring means including main and secondary compression springs, said main compression spring having a stepped axially extending exterior surface with a front narrow neck and a rear enlarged body, said main compression spring sized and shaped to slidably fit and reciprocate within said stepped bore of said lock barrel, said secondary compression spring having a stepped axially extending exterior surface with a front enlarged body and a rear narrow neck, said rear narrow neck of said secondary compression spring sized and shaped to coaxially and slidably fit within said front narrow neck of said main compression spring, the forward movement of said front narrow neck of said main compression spring being limited by said enlarged body of said secondary compression spring, said front exterior narrow neck portion of said normally unretracted main compression spring extending across and closing said inner aperture of each said passageway thereby forcing each said locking member outwardly to its locking position, said front exterior narrow neck portion of said main compression spring when retracted, moving rearwardly across and opening said inner aperture of each said passageway thereby permitting each said locking member to move inwardly to its unlocking position;

(e) the operation of an authorized key inserted in said lock causing said main compression spring to be rearwardly compressed and causing said enlarged body of said secondary compression spring to be held forwardly of said passageways, said rearwardly compressed main compression spring and said forwardly maintained secondary compression spring co-operating to permit said locking members to fall to their inward unlocking position.

2. The high security lock as claimed in claim 1 wherein said locking member is a locking ball and said outer aperture of each said passageway has a small inwardly extending rim preventing said locking ball from completely escaping through said outer aperture.

3. The high security lock as claimed in claim 1 wherein said rear enlarged body of said main compression spring has a compressible open coiled rear end and a noncompressible close coiled central portion, said neck of said main compression spring being close coiled.

4. The high security lock as claimed in claim 1 wherein said front enlarged body of said secondary compression spring has a compressible open coiled front end and a noncompressible close coiled central portion, said neck of said secondary compression spring being close coiled.

5. The high security lock as claimed in claim 4 wherein said close coiled central portion of said secondary compression spring defines a shoulder which engages the free end of said close coiled neck of said main compression spring, said secondary compression spring expanding rearwardly when an unauthorized key or pick is inserted and operated to retract and rearwardly compress said main compression spring, said close coiled central portion maintaining said locking members in their outward position.

6. The high security lock as claimed in claim 1 wherein said compression spring means includes a third compression spring sized and shaped to coaxially and slidably fit within said front enlarged body of said secondary compression spring.

7. The high security lock comprising:

(a) a hollow cylindrical lock barrel having a closed front end and an apertured rear end, said lock barrel having a stepped axially extending bore, the front bore having a relatively small diameter and the rear bore having a relatively large diameter;

(b) said stepped barrel bore having an annular shoulder forming the junction between said front bore and said rear bore;

(c) at least two radially extending passageways running from an outer aperture in the exterior surface of said lock barrel to an inner aperture in the front bore of said lock barrel, and a locking ball movably mounted in each said passageway, the outer aperture of each said passageway having a small inwardly extending peripheral rim preventing said locking member from completely escaping through said outer aperture; and (d) compression spring means including a main compression spring and a secondary compression spring, said main compression spring having a stepped axially extending exterior surface with a front narrow neck, said secondary compression spring having a stepped axially extending exterior surface with a rear narrow neck and a front enlarged body;

(e) said narrow neck of said normally unretracted main compression spring extending forwardly across said inner aperture of each said passageway thereby forcing said locking members outwardly to their locking position, said main compression spring being rearwardly compressed and said secondary compression spring being retained in its position when an authorized key is fully inserted and operated, said rearwardly compressed main compression spring and said forwardly retained secondary compression spring co-operating to permit said locking balls to fall to their inward unlocking position.

8. The high security lock as claimed in claim 7 wherein said main compression spring has a compressible open coiled rear end and a noncompressible close coiled central portion, said neck of said main compression spring being close coiled.

9. The high security lock as claimed in claim 7 wherein said main compression spring is wound in a first direction.

10. The high security lock as claimed in claim 9 wherein said secondary compression spring has a compressible open coiled front end and a noncompressible close coiled central portion, said neck of said secondary compression spring being close coiled.

11. The high security lock as claimed in claim 10 wherein said secondary compression spring is wound in a second direction which is opposite said first direction.

12. The high security lock as claimed in claim 11 wherein said close coiled central portion of said secondary compression spring defines a shoulder which engages the free end of said neck of said main compression spring, said shoulder moving rearwardly when an unauthorized key or pick is inserted and operated to retract and rearwardly compress said main compression spring, said rearwardly positioned central portion maintaining said locking balls in their outward locking position.

13. The high security lock as claimed in claim 12 wherein said compression spring means includes an auxiliary compression spring sized and shaped to coaxially and slidably fit within said front end of said secondary compression spring.

14. The high security lock as claimed in claim 13 wherein said auxiliary spring is wound in said first direction.

15. A high security lock comprising:

(a) a hollow cylindrical lock barrel having a closed front end and an apertured rear end, said lock barrel having a stepped axially extending bore, the front bore having a relatively small diameter and the rear bore having a relatively large diameter;

(b) said stepped barrel bore having an annular shoulder forming the junction between said front bore and said rear bore;

(c) at least two radially extending passageways running from an outer aperture in the exterior surface of said lock barrel to an inner aperture in the front bore of said lock barrel, and a locking member mounted in each said passageway for limited movement therein, said locking member restrained from completely escaping through said outer aperture; and (d) a main compression spring extending axially in said stepped bore, said main compression spring sized and shaped to slidably fit and reciprocate within said stepped bore, said main compression spring having a compressible open coiled rear end, a noncompressible close coiled central portion, and a noncompressible close coiled front neck, said front neck adapted to normally engage and maintain said locking members in the locking position, a secondary compression spring extending axially in said stepped bore, said secondary compression spring having a compressible open coiled front end, a noncompressible close coiled central portion, and a noncompressible close coiled rear neck, said secondary compression spring being positioned forward of said main compression spring, said main compression spring central portion adapted to be grasped internally and moved rearwardly by utilizing an authorized key insertable in said lock from said apertured rear end of said cylinder, actuation of the special key also blocking rearward movement of said secondary compression spring permitting said locking members to fall to their inward unlocking position.

16. The high security lock as claimed in claim 15 wherein said secondary compression spring contacts said main compression spring, and said main compression spring and said secondary compression spring have a combined axial length which is greater than the axial length of said bore.

17. The high security lock as claimed in claim 16 wherein said close coiled central portion of said secondary compression spring defines a shoulder which engages the free end of said front neck of said main compression spring, said shoulder moving to a rearward position when an unauthorized key or pick is inserted and operated to pull said main compression spring to its rearward position, said rearwardly positioned shoulder and central portion maintaining said locking balls in their outward locking position.

18. The high security lock as claimed in claim 17 wherein said main compression spring and said secondary compression springs are coiled in opposite directions.

* * * * *